US011448068B2

(12) United States Patent
Lorant et al.

(10) Patent No.: US 11,448,068 B2
(45) Date of Patent: Sep. 20, 2022

(54) OPTIMIZATION OF BORING BY A TUNNEL BORING MACHINE AS A FUNCTION OF GROUND/MACHINE INTERACTIONS

(71) Applicant: BOUYGUES TRAVAUX PUBLICS, Guyancourt (FR)

(72) Inventors: Estelle Lorant, Massy (FR); Philippe Marimoutou, La Ciotat (FR); Nicolas Janicaud, Clichy (FR); Nicolas Braud, Boulogne Billancourt (FR)

(73) Assignee: BOUYGUES TRAVAUX PUBLICS, Guyancourt (FR)

( * ) Notice: Subject to any disclaimer, the term of this patent is extended or adjusted under 35 U.S.C. 154(b) by 310 days.

(21) Appl. No.: 16/674,882

(22) Filed: Nov. 5, 2019

(65) Prior Publication Data

US 2020/0141237 A1 May 7, 2020

(30) Foreign Application Priority Data

Nov. 5, 2018 (FR) ..... 1860155

(51) Int. Cl.
*E21D 9/10* (2006.01)
*E21D 9/00* (2006.01)

(52) U.S. Cl.
CPC ..... *E21D 9/108* (2013.01); *E21D 9/003* (2013.01); *E21D 9/1006* (2013.01)

(58) Field of Classification Search
CPC .... E21D 9/00; E21D 9/06; E21D 9/08; E21D 9/10; E21D 9/003; E21D 9/108; E21D 9/1093
See application file for complete search history.

(56) References Cited

U.S. PATENT DOCUMENTS 5,330,292 A 7/1994 Sakanishi et al.
2008/0024000 A1 1/2008 Moulin et al.
2017/0356730 A1* 12/2017 Wang ..... B25J 9/1697

FOREIGN PATENT DOCUMENTS

CN 107577862 A 1/2018
EP 1098066 A1 5/2001
(Continued)

OTHER PUBLICATIONS

Lau et al., "Applying radial basis function neural networks to estimate next-cycle production rates in tunnelling construction", Tunnelling and Underground Space Technology, vol. 25, 2010, pp. 357-365.

(Continued)

*Primary Examiner* — Sunil Singh
(74) *Attorney, Agent, or Firm* — Womble Bond Dickinson (US) LLP

(57) ABSTRACT

The invention relates to a method (S10) for optimizing the characteristics of a tunnel boring machine, particularly a tunnel boring machine of the slurry pressure or VD type, said method comprising the following steps:

S0: determining a ground/machine interaction model,
S11: instantaneous measurement of the set of specific boring parameters of the tunnel boring machine,
S13: determining the group of individuals corresponding to the boring parameters measured in step S11 by means of the ground/machine interaction model,
S14: optimizing the characteristics of the tunnel boring machine as a function of the group of individuals thus determined.

11 Claims, 2 Drawing Sheets

(56) References Cited

FOREIGN PATENT DOCUMENTS

| | | | |
|---|---|---|---|
| EP | 1253287 | A1 | 10/2002 |
| FR | 2874959 | A1 | 3/2006 |
| JP | 09-228778 | A | 9/1997 |
| JP | 11-270283 | A | 10/1999 |
| KR | 10-2018-0116922 | A | 10/2018 |
| WO | 03/87537 | A1 | 10/2003 |

OTHER PUBLICATIONS

Preliminary Research Report received for French Application No. 1860155, dated Sep. 6, 2019, 2 pages (1 page of French Translation Cover Sheet and 1 page of original document).

* cited by examiner

OPTIMIZATION OF BORING BY A TUNNEL BORING MACHINE AS A FUNCTION OF GROUND/MACHINE INTERACTIONS

FIELD OF THE INVENTION

The invention relates generally to boring a tunnel, and more particularly to the optimization of boring by a tunnel boring machine of the slurry pressure or variable density type, as a function of the nature of the ground at the tunnel face.

TECHNOLOGICAL BACKGROUND

Machines for excavating tunnels, called tunnel boring machines, are known, which include a mobile structure of large dimensions consisting of a large mobile factory ahead of which is positioned a shield having a cross section compatible with the future cross section matching the final shape of the tunnel (tunnel with a cross section that is circular, bilobate, rectangular . . . )

The anterior portion of the shield which comes into contact with the tunnel face to accomplish the cutting of the geological formation that is being penetrated by the tunnel includes a cutting head supporting the working tools, in particular cutting disks and blades, driven in rotation at a variable speed and coupled with a thrust which is adapted to the nature of the ground to be excavated.

Known from document WO 03/087537 is a device comprising a wear detector, a rotation speed detector and a load detector placed on the cutting disk support. Also known are other publications (EP 1 098 066, U.S. Pat. No. 5,330,292, EP 1 253 287, JP 11 270283, JP 09 228 778) which place data acquisition sensors on the cutting disk shaft or on the cutting head shaft or on the cutting head.

It has also been proposed, in document FR 2 874 959, to place on each cutting disk in question one or more sensors selected among sensors capable of supplying signals representing the penetration force of the cutting disk into the ground, the state of rotation of the cutting disk, the position of the cutting disk in the ground and the temperature of the cutting disk so as to supply more precise information on the nature of the ground to be excavated. This method has proven very effective in that it frees itself from the deformations of the shaft or of the cutting disk support, the cutting head or the shaft of the cutting head, when measuring the different boring parameters.

Regardless of the proposed methods, the pilot must systematically deduce, from the values measured by the different sensors, the conditions imposed by the ground being penetrated and adjust different characteristics of the tunnel boring machine (speed of advance, torque, etc.) as a function of these values. This adjustment must, however, take into account the type of tunnel boring machine used, and therefore requires considerable expertise on the part of the pilot. Moreover, the nature of the ground is not generally homogeneous, so that the values obtains may not be representative of the true nature of the ground at the tunnel face.

SUMMARY OF THE INVENTION

One object of the invention is therefore to propose a method for optimizing the characteristics of a tunnel boring machines, in particular a slurry pressure or variable density type tunnel boring machine, which allows optimizing in real time the characteristics of the tunnel boring machine so as to improve boring without risking damaging the tunnel boring machine, regardless of the nature of the ground at the tunnel face or even the type of tunnel boring machine used.

To this end, the invention proposes a method for determining a ground/machine interaction model during boring of a ground by a tunnel boring machine, in particular a tunnel boring machine of the slurry pressure or VD type, said method comprising the following steps:

- S1: obtaining a set of parameters characterizing a bore by at least one given tunnel boring machine over at least one boring site, particularly a tunnel boring machine of the slurry pressure or VD type,
- S2: identifying a set of formulas depending on all or part of the boring parameters,
- S3: determining a set of variables based on the formulas thus identified,
- S4: applying a non-supervised classification algorithm to the variables so as to obtain groups of individuals identified according to a predefined criterion of said algorithm,
- S5: applying a supervised classification algorithm to the variables and the groups of individuals thus determined so as to obtain a ground/machine interaction model connecting said variables to said groups.

Certain preferred but non-limiting features of the method for determining an interaction model described above are the following taken individually or in combination:

- the non-supervised classification comprises a segmentation (clustering) algorithm, for example a K-MEANS algorithm.
- the supervised classification comprises a random forest algorithm.
- the variables depend on at least one of the following boring parameters: a torque of a cutting wheel of the given tunnel boring machine, a speed of rotation of the cutting wheel of the given tunnel boring machine, a speed of advance of the given tunnel boring machine, a contact force of the given tunnel boring machine, a surface area of the cutting wheel of the given tunnel boring machine, a radius of the cutting wheel of the given tunnel boring machine, a confinement pressure at the axis of the given tunnel boring machine.
- the step S4 consisting of non-supervised classification determines between 8 and 10 different groups of individuals.
- each variable describes a ground segment, such as a given ring deposited by at least one given tunnel boring machine, on at least one boring site and in which the groups of individuals determined in step S4 correspond to groups of ground segments, particularly groups of rings deposited by at least one given tunnel boring machine on at least one boring site.

According to a second aspect, the invention also proposes a process for optimizing the characteristics of a tunnel boring machine, particularly a tunnel boring machine of the slurry pressure or VD type, said method comprising the following steps:

- S0: determining a ground/machine interaction model according to one of claims 1 to 5,
- S11: instantaneous measurement of the set of specific boring parameters of the tunnel boring machine,
- S13: determining the group of individuals corresponding to the boring parameters measured in step S11 by means of the ground/machine interaction model,
- S14: optimizing the characteristics of the tunnel boring machine as a function of the group of individuals thus determined.

Certain preferred but non-limiting features of the optimization method above are the following, taken individually or in combination:

the optimization method also comprises, prior to step S13, a step consisting of calculating all or a part of the variables determined in step S3 based on the boring parameters measured in step S11, and wherein, during step S13, the group of individuals is determined by applying the ground/machine interaction model and to the variables thus determined and/or during boring, the tunnel boring machine successively deposits a plurality of rings, and the steps S11 to S14 are repeated during the deposit of each ring.

According to a third aspect, the invention also proposes a computer program product comprising code instructions for executing a method for determining a ground/machine interaction model during boring of a ground by a tunnel boring machine, particularly a tunnel boring machine of the slurry pressure or VD type as described above and/or a method for optimizing the characteristics of a tunnel boring machine, particularly a tunnel boring machine of the slurry pressure or VD type as described above.

According to a fourth aspect, the invention proposes a storage means readable by data processing equipment on which a computer program product comprises code instructions for the execution of a method for determining a ground/machine interaction model during boring of a ground by a tunnel boring machine, particularly a tunnel boring machine of the slurry pressure or VD type as described above.

BRIEF DESCRIPTION OF THE DRAWINGS

Other features, aims and advantages of the present invention will appear more dearly upon reading the detailed description that follows and with reference to the appended drawings given by way of non-limiting examples and in which.

DETAILED DESCRIPTION OF AN EMBODIMENT

In order to optimize parameters for a tunnel boring machine 1, in particular a tunnel machine 1 of the slurry pressure or variable density (VD) type, during boring, the invention proposes to first determine a ground/machine interaction model (method S0). The optimization of the characteristics of the tunnel boring machine 1 is then accomplished based on this ground/machine interaction model (optimization method S10), and no longer solely based on the theoretical ground at the tunnel face. In fact the method S10 starts with the principle according to which grounds of different natures can interact in a similar manner with the anterior portion 3 of the tunnel boring machine 1 depending for example on the depth where these grounds are situated, but also on the condition of the machine.

Figure 1:
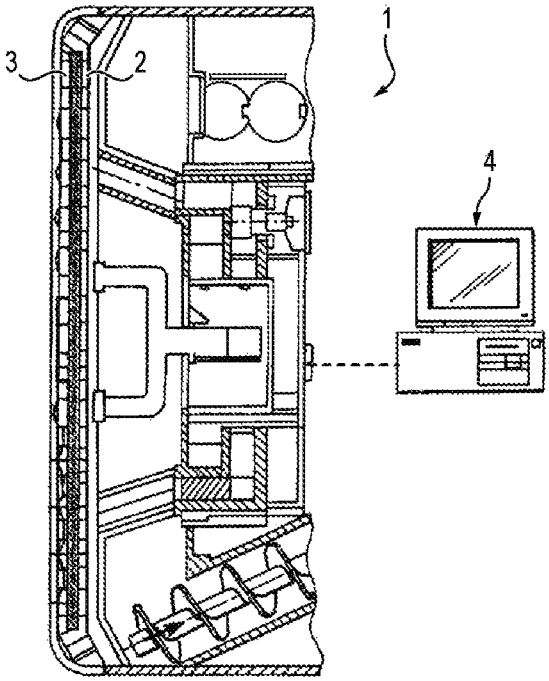
FIG. 1 is a partial section view of an embodiment of a tunnel boring machine conforming to one embodiment of the invention.
Figure 2:
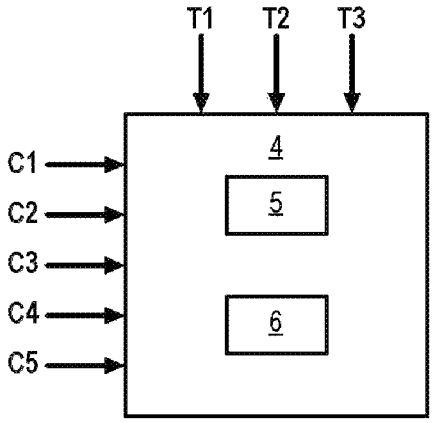
FIG. 2 illustrates schematically an exemplary embodiment of a processing unit adapted to execute the optimization method according to the invention, as well as the input parameters of said processing unit.
Figure 3:
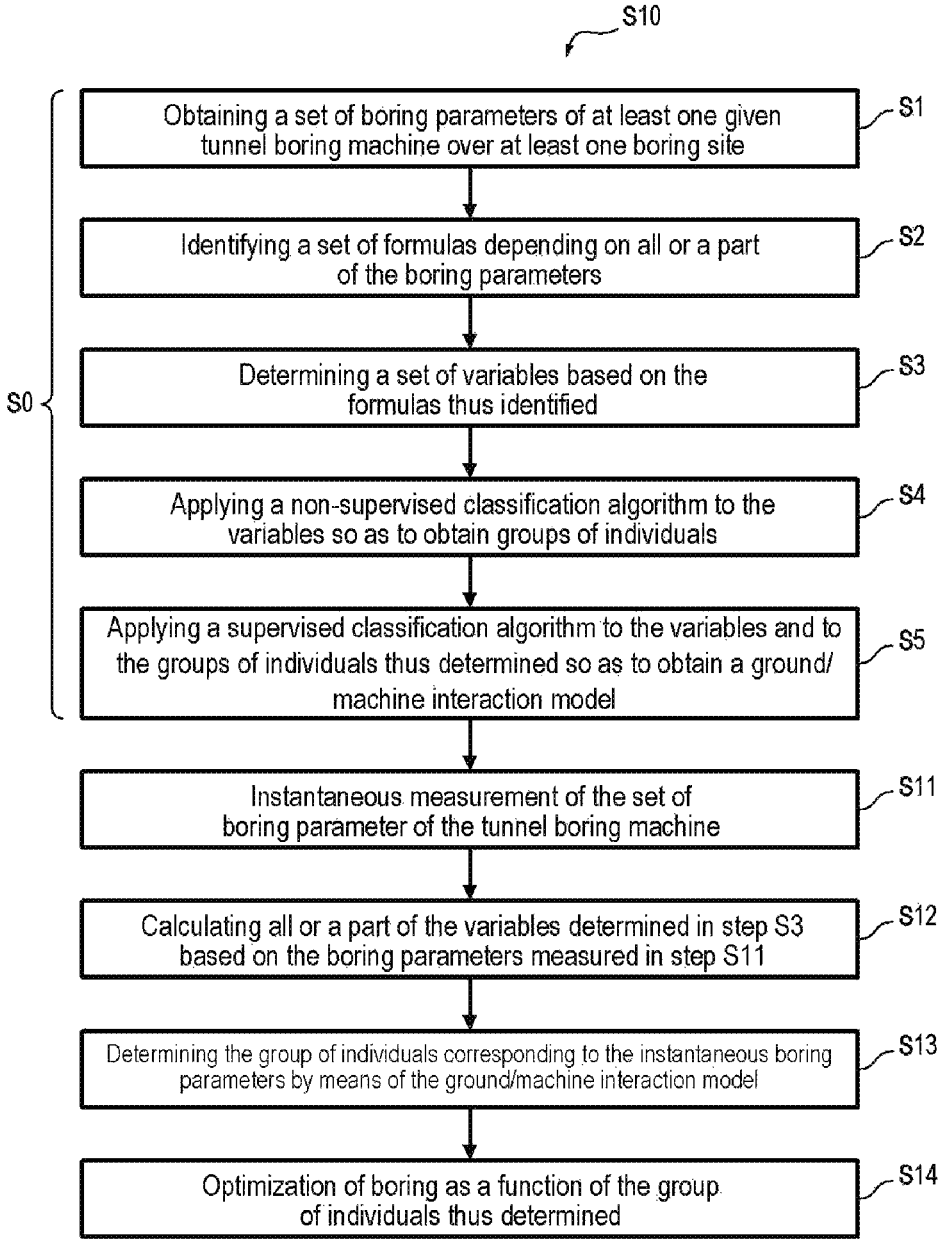
FIG. 3 is a flowchart illustrating the steps of an exemplary embodiment of an optimization method conforming to the invention.

The method S0 for determining a ground/machine interaction model and the method S10 for optimizing can be implemented by a processing unit 4 adapted to execute the method(s) S10, a computer for example (which can be housed in the tunnel boring machine 1 or remotely and connected by wire to said tunnel boring machine 1) or a distant server possessing processing means. Thus, the processing unit 4 can for example comprise a memory 5 in which are stored the code instructions for the execution of the method(s) and a computer 6 of the processor, microprocessor, microcontroller etc. type configured to execute said instructions. As we will see later, this processing unit 4 uses as input specific boring parameters, which can comprise measurements obtained by one or more sensors C1-C5 attached to the tunnel boring machine and giving information on the bore (confinement pressure of the tunnel boring machine 1 axis, torque of the cutting wheel 2 of the tunnel boring machine, speed of advance of the tunnel boring machine 1), or characteristics T1-T3 which can be entered directly into the processing unit 4 and which characterize the tunnel boring machine 1 itself (radius of the cutting wheel 2 of the tunnel boring machine 1, surface area of the cutting wheel 2 of the tunnel boring machine 1, etc.). The specific parameters therefore either originate in the sensors C1-C5 placed on the tunnel boring machine 1 and capable of measuring an instantaneous value of the corresponding parameter, or connected to the tunnel boring machine 1 itself and are fixed (parameters T1-T3 in FIG. 2).

During a first phase S0, the ground/machine interaction model during boring of a ground by a tunnel boring machine 1 is determined, preferably in the case of a tunnel boring machine 1 of the slurry pressure or VD type.

To this end, during a first step S1, a set of specific parameters for boring by at least one given tunnel boring machine 1 on at least one boring site is obtained.

As the method applies preferably to tunnel boring machines of the slurry pressure or VD type, the boring parameters are preferably obtained for such tunnel boring machines.

In one embodiment, such specific parameters are obtained for different types of sites, in which the nature of the ground differs, in order that the ground/machine interaction model be as complete as possible and can then be applied to any type of site. In one embodiment, these specific parameters can have been pre-stored in a database grouping all these specific parameters measured for different boring sites. During step S1, the specific parameters are then obtained by querying said database.

The boring parameters can in particular comprise all or a part of the following specific parameters: machine parameters gathered by sensors C1-C4 of the processing unit 4 of the tunnel boring machine 1 on the site concerned, characteristics reflecting geological longitudinal profiles, measurements obtained by sensors C1-C5 during in situ tests, measurements obtained by sensors C1-C5 during laboratory tests, sensors C1-C5 place on instrumented cutting disks of the tunnel boring machine 1, characteristics originating in reports supplied by a slurry treatment station of the tunnel boring machine 1, characteristics obtained by excavation risk analysis, measurements of surface compaction obtained by dedicated sensors, measurements carried out during the maintenance of the cutting disks and blade on the cutting wheel 2, characteristics reflecting the configuration of the tunnel boring machine 1 (radius of the cutting wheel 2, surface area of the cutting wheel 2, etc.).

More precisely, during step S1, all or a part of the following parameters can be obtained, for each site and each tunnel boring machine 1 examined: a torque of the cutting wheel 2 of the tunnel boring machine 1 examined, a speed of rotation of the cutting wheel 2 of the tunnel boring machine 1 examined, a speed of advance of the tunnel boring machine 1 examined, a surface area of the cutting wheel 2 of the tunnel boring machine 1 examined, a radius of the cutting wheel 2 of the tunnel boring machine 1 examined, a confinement pressure at the axis of the tunnel boring machine 1 examined. The torque is for example calculated based on measurements obtained by several sensors C1 measuring the torque, for example by means of frequency converters of each of the motors, placed on each of the principal motors of the main drive. The speed of rotation of the cutting wheel 2 is for example measured by means of a sensor C2 of the angular encoder type, which can be optically readable, placed on the rotating joint of the cutting wheel 2. The speed of advance of the tunnel boring machine 1 can be calculated based on measurements obtained by several ram elongation sensors C3, for example cable type position sensors C2 place on the different rams of the tunnel boring to machine, with a time derivative for obtaining speed. Such a calculation is accomplished in real time by the processing unit 4. The contact force, for example, is calculated based on measurements obtained by several sensors as a function of the configuration of the tunnel boring machine, particularly as a function of its articulations and can for example be measured by means of sensors C4 of the pressure sensor type placed on the hydraulic rams of the cutting head, on the rams of the articulations and on the thrust rams of the rings. The confinement pressure at the axis is for example measured by means of a sensor C5 of the pressure sensor type, placed in the confinement chamber as closely as possible to the axis of rotation of the cutting wheel.

The specific parameters are obtained for all the rings deposited by the tunnel boring machine 1 concerned on the site.

If necessary, a step consisting of sorting the boring parameters can also be carried out, so as not to take abnormal values into account in subsequent steps of the method S0. To this end, out-of-limit values of the different sensors C1-C5 used to obtain these parameters are set aside.

During a second step S2, a set of formulas depending on all or part of the boring parameters are identified.

The formulas can in particular comprise or be established based on professional formulas using all or part of the boring parameters in order to create combinations having a high statistical power and which are able to be interpreted on site. The professional formulas used during this step can be known and correspond for example to specific energy formulas for excavation of the boring medium and with the desired non-dimensionalizing so as to be able to generalize the data thus obtained to all sites. If necessary, these professional formulas can be adjusted so as to increase their statistical power.

In one embodiment, each professional formula can be a combination of all or part of the following boring parameters: the torque of the cutting wheel 2, the speed of rotation of the cutting wheel 2, the speed of advance of the tunnel boring machine 1, the surface area of the cutting wheel 2, the radius of the cutting wheel 2, the confinement pressure at the axis.

Optionally, the formulas thus identified can be non-dimensionalized as a function of the type of tunnel boring machine 1 used so that the model is applicable to any type of tunnel boring machine 1 and the values are comparable to one another. To this end, each of the formulas is divided by the diameter of the tunnel boring machine 1 used on the site concerned.

In one embodiment, the following professional formulas can for example be established:

- the rotation energy $SEE_{rot}$, which depends on the torque C, the surface area S and the rotation speed a of the cutting wheel 2 as well as the speed of advance v of the tunnel boring machine 1.
- the translation energy index $SEE_{trans}$, which depends on the speed of rotation W and the surface area S of the cutting wheel 2 as well as the contact force F (namely the contact force between the anterior portion 3 of the shield and the tunnel face).
- the friction coefficient f, which depends on the torque C and the radius R of the cutting wheel 2 as well as the contact force F.

For example, the rotation energy $SEE_{rot}$ (in $J/m^3$) can be determined as follows:

$$SEE_{rot}=(C*\omega)/(v*S)$$

The translation energy index $SEE_{trans}$ (in $J/m^3/m*s^{-1}$) can be determined as follows:

$$SEE_{trans}=F/(v*S)$$

where F is the contact force (in kN)

The friction coefficient f (nondimensional) can be determined as follows:

$$f=3/2*C/(F*R)$$

During a third step, a set of variables can then be determined based on the formulas thus identified. For this purpose, the formulas are calculated using the value of the boring parameters obtained in step S1. If necessary, these formulas can possibly be transformed so as to increase their statistical power and/or to reduce the quantity of information processed.

For example, the variables can be obtained by determining, on a complete ring, the average of the formulas applied to the boring parameters, their maximum and/or their standard deviation. In other words, the variables are aggregated, at the level of the ring, by calculating the average, the maximum and/or the standard deviation for all the formulas.

For example, in the case where the formulas identified in step S2 comprise the rotation energy $SEE_{rot}$, the translation energy index $SEE_{trans}$ and the friction f, the variables can be calculated by determining, for each formula, the average of the formula on a complete ring, and by also determining the maximum of the friction and its standard deviation for each complete ring. Five variables are thus obtained, corresponding respectively to the average of the rotation energy on a ring, the average of the translation energy index on a ring, and the average, the maximum and the standard deviation of the friction per ring.

It will be appreciated that a principal component analysis (PCA) applied to these five variables allows obtaining three principal axes along which are distributed the variables and having a variance of 99%. This therefore confirms that the information is effectively summarized by these three axes, which allow both obtaining an opposition of the variables and formulas which supply a clear professional interpretation.

In particular, the first axis opposes the friction coefficient to rotation and translation energies. In particular, when the individuals (i.e. the rings on which the variables have been calculated) are situated in the positive values of this axis, it implies that there are many instances of friction for little energy expended. This phenomenon is characterized in the professional sense by the clogging effect of the cutting wheel 2 (for example, the clogging effect of a very clayey ground). On the contrary, when the individuals are situated in the negative values of this axis, they do not undergo this clogging effect. This first axis therefore reflects the clogging of the machine by the ground.

The second axis applies primarily to rotation and translation energies. If the individuals are situated in the positive values of this axis, that implies a high expenditure of energy for advancing and excavating the ground, which is characterized in the professional sense by hardness of the important ground facing the cutting wheel 2 (as is the case for granitic rock). On the contrary, when the individuals are situated in the negative values of this axis, the ground is rather loose so that little energy is necessary for advancing. This second axis therefore reflects the hardness of the ground.

The third axis applies to strong but stable friction in association with the rotation energy and in opposition to the translation energy. If the individuals are situated in the positive values of this axis, that implies that there is high friction and strong energy consumption in rotation, which is characterized in the professional sense by the heterogeneity of the ground facing the cutting disk 2 (as is the case for example in a polylithological phase such as a ground comprising clay lenses or blocks of rock within another type of ground—which will be identified by means of the other axes). On the contrary, when the individuals are situated in the negative values of this axis, this is characterized by scattering. This third axis therefore reflects the homogeneity of the ground.

Each of these axes therefore has a professional meaning allowing their interpretation and thus facilitating the application of a non-supervised classification algorithm to the variables to obtain a set of groups of individual (step S4) and a supervised classification algorithm to the groups of individual and these variables so as to obtain the ground/machine interaction model (step S5).

More precisely, during a fourth step S4 a non-supervised classification of the rings described by these variables is therefore determined, so as to obtain a set of groups of rings (or groups of individuals) according to a predefined criterion of the algorithm.

This step consisting of non-supervised classification has the object of identifying, in the set of five variables applied to the set of complete rings, one or more homogenous groups which satisfy the predefined criterion.

The non-supervised classification can in particular comprise a segmentation algorithm (clustering), for example a K-MEANS algorithm. This is not limiting, however other non-supervised classification algorithms can be implemented without departing from the scope of the present application, such as, by way of non-limiting examples, a hierarchical upstream classification algorithm or a DBSCAN (Density-Based Spatial Clustering of Applications with Noise) algorithm.

In a manner known per se, the K-MEANS algorithm is based on the random initialization of K points becoming K centers of gravity, then accomplishes the assignment of the points to the groups of individuals with regard to their (minimum) distance to the k centers. The algorithm then recalculates the position of the k center of gravity as soon as a new point is assigned to the group. It is therefore an iterative algorithm that finishes based on a predefined criterion which can comprise in particular a limiting number of iterations, stabilization of the k centers of gravity, an assignment of all the points to one group, etc.

During the implementation of this step, calculations of coefficients such as the silhouette coefficient can give an optimal number of groups of individuals, corresponding to homogeneous groups of individuals very distant from one another, as a function of the variables obtained during the third step S3 of the method S0 and the boring parameters obtained in step S1. This number of groups of individuals can, if necessary, be modified so as to obtain a degree of precision and refinement more adapted to the professional application of the method S0, and particularly the need to detail certain ground/machine interactions for the purpose of optimizing boring by the tunnel boring machine 1.

Typically, for the boring parameters identified by the Applicant and the five variables described above, the K-MEANS algorithm allows segmenting the variables into six optimum groups of individuals. The Applicant, however, has increased the number of groups of individuals to ten so as to obtain a more precise refining of the different groups of individuals.

In order to allow a professional interpretation of these groups of individuals, these have been placed on the three axes previously identified by the PCA (dogging/hardness/homogeneity). It emerges that three of these groups of individuals represent three levels of hardness which can correspond for example to concrete, to more or less decomposed granite, to pebbles, etc. Moreover, four of the groups of individuals represent four intermediate levels of hardness and clogging which can correspond for example to grounds of the sand, alluvium, sand-clay, very decomposed granite type. Finally, three groups of individuals represent three levels of clogging which can correspond for example to different types of day ground.

During a fifth step S5, a supervised classification algorithm is applied to the variables and to the groups of individuals determined in step S4.

This step S5 consisting of supervised classification has the object of obtaining a ground/machine interaction model connecting said variables to said groups of individuals.

Supervised classification can in particular comprise a random forest algorithm. This is not limiting, however; other supervised classification algorithms being implementable without departing from the scope of the present application, such as, by way of non-limiting examples, a decision tree, a support vector machine or a k-nearest neighbors method.

In a manner known per se, the random forest algorithm uses a set of decision trees to which only a fragmented vision of the problem is supplied (a sample taken at random both in terms of individuals and of variables), this in order to predict the classification. Each tree will thus classify the individual on one of the groups of individuals determined in step S4 as a function of the information that was supplied to it. The random forest then takes into account the decision of each tree and assigns the groups of individuals that have received the most votes to the individual (the ring). The algorithm thus allows obtaining a model connecting the variables to the groups of individuals determined in step S4 and thus characterizing the ground/machine interactions that are possible during a bore by a tunnel boring machine 1.

Thanks to the method S0, a ground/machine interaction model has thus been determined connecting the variables to the groups of individuals. This model is non-dimensionalized and can therefore be applied to any tunnel boring machine 1, regardless of its size or its type (slurry pressure or VD), but also to any site, in that the set of interactions as a function of the nature of the ground has preferably been encountered in the sites based on which the boring parameters were obtained.

It will be noted that the method S0 allows determining the ground/machine interactions, and not the type of ground encountered by the anterior portion 3 of the shield. Two grounds of different natures can thus generate substantially the same ground/machine interaction and belong to the same group of individuals. And it is indeed this interaction which is determined by the method S0 which is relevant for optimizing boring, and not the nature of each ground.

During a second phase, corresponding to the boring of a tunnel by a tunnel boring machine 1, particularly of the slurry pressure or VD type, characteristics of the tunnel boring machine 1 can then be optimized (step S10) by applying the ground/machine interaction model thus determined.

It will be noted that this optimization S10 is preferably accomplished for each ring deposited by the tunnel boring machine 1.

For this purpose, during a first step S11, the specific boring parameters are obtained instantaneously for each ring. The specific parameters comprise the boring parameters necessary for the establishment of the variables identified in step S2, and can either be entered directly in the processing unit 4, or measured by sensors C1-C5 of the tunnel boring machine 1.

In order for these data to be comparable, the calibration of the different sensors C1-C5 used is accomplished in a similar manner between the sensors used for obtaining the boring parameters in step S1 and the sensors used for the instantaneous measurement of said boring parameters in step S11.

During a second step S12, the variables which have been determined in step S3 are calculated for each ring. Thus, in the example detailed above, the average of the rotation energy on the ring, the average of the translation energy index on the ring, and the average, the maximum and the standard deviation of the friction for the ring, are recalculated, or a total of five variables.

This, however, is not limiting, the variables being calculable for ground segments, which can for example measure a few centimeters in length, instead of said rings. Hereafter, for the sake of simplification, the invention will be detailed in the case where the variables are calculated per ring, although this is not limiting.

During a third step S13, the ground/machine interaction model is applied to the boring parameters so as to determine the group of individuals corresponding to the instantaneous boring parameters which were measured for this ring. More precisely, during step S13, the variables determined in step S12 are calculated for each ring, the ground/machine interaction model being applied to said variables.

In the case where the variables are calculated per ground segment, the ground/machine interaction model is of course applied to said ground segments.

The group of individuals corresponding the instantaneous boring parameters of the tunnel boring machine for this ring are then deduced from it. It is then possible to determine if the characteristics of the tunnel boring machine 1 can be modified, considering the group of individuals, in order to optimize the boring of the tunnel.

The characteristics of the tunnel boring machine 1 which can be modified as a function of the groups of individuals comprise in particular the speed of advance of the tunnel boring machine 1, the contact force, the speed of rotation of the cutting wheel 2 of the tunnel boring machine 1 and the torque of the cutting wheel 2 of the tunnel boring machine 1. In the case in point, these characteristics correspond substantially to the specific parameters measured by the different sensors C1-C5. This is only an example; the characteristics optimized on the tunnel boring machine 1 can be different from the specific parameters used in the ground/machine interaction model.

Modification of the characteristics of the tunnel boring machine 1 can be performed manually, by the operator of the tunnel boring machine 1.

For this purpose, in one embodiment, statistics grouping, for each identified group of individuals, information relating to the characteristics of the tunnel boring machine can be accomplished. These statistics can for example comprise an average, a minimum, a maximum and/or an optimal value of each of these characteristics of the tunnel boring machine 1, within each group. For example, an average, a minimum, a maximum and/or an optimal value of the speed of advance of the tunnel boring machine 1, of contact force, of speed of rotation of the cutting wheel 2 of the tunnel boring machine, and/or the torque of the cutting wheel 2 of the tunnel boring machine 1, can be associated with each group of individuals.

These statistics can then be communicated in real time to the operator so as to assist him in making decisions and possibly in modifying one or more of these characteristics of the tunnel boring machine 1.

As a variant, this information can be used in order to automate said decision-making.

It will be noted that the invention also relates to a computer program product comprising code instructions for executing the method of determination of a ground/machine interaction model or the method of optimizing characteristics for a tunnel boring machine 1 conforming to the invention, as well as storage means readable by data processing equipment (for example a hard disk of the computer 6) on which is found this computer program product.

The invention claimed is:

1. A method:

obtaining from a database a set of boring parameters characterizing formation of a bore by at least one given tunnel boring machine over at least one boring site, the set of boring parameters including at least one of a torque of a cutting wheel of the at least one given tunnel boring machine, a speed of rotation of the cutting wheel of the at least one given tunnel boring machine, a speed of advance of the at least one given tunnel boring machine, a contact force of the at least one given tunnel boring machine, a surface area of the cutting wheel of the at least one given tunnel boring machine, a radius of the cutting wheel of the at least one given tunnel boring machine, and a confinement pressure at an axis of the at least one given tunnel boring machine, identifying a set of energy formulas depending on at least one of the boring parameters, determining a set of variables based on the energy formulas thus identified, the set of variables including at least one of an average, maximum, and standard deviation of the energy formulas, applying a non-supervised classification algorithm to the variables so as to obtain groups of individuals identified according to a predefined criterion of the non-supervised classification algorithm, applying a supervised classification algorithm to the variables and to the groups of individuals thus determined so as to obtain a ground/machine interaction model connecting the variables to the groups of individuals, measuring, while boring a ground with a tunnel boring machine, at least one boring parameter, the at least one boring parameter comprising a torque of a cutting wheel of the tunnel boring machine, a speed of rotation of a cutting wheel of the tunnel boring machine, a speed of advance of the tunnel boring machine, and a contact force of the tunnel boring machine, determining the group of individuals corresponding to the measured at least one boring parameter using the ground/machine interaction model, and modifying at least one of the boring parameters of the tunnel boring machine as a function of the group of individuals thus determined.

2. The method according to claim 1, wherein the non-supervised classification comprises a clustering algorithm.

3. The method according to claim 2, wherein the non-supervised classification comprises a K-MEANS algorithm.

4. The method according to claim 1, wherein the supervised classification comprises a random forest algorithm.

5. The method according to claim 1, wherein applying a non-supervised classification algorithm to the variables comprises determining between 8 and 10 different groups of individuals.

6. The method according to claim 1, wherein each variable describes a ground segment, and wherein the groups of individuals determined correspond to groups of ground segments.

7. The method according to claim 6, wherein the ground segment is a given ring deposited by at least one given tunnel boring machine, on at least one boring site, and wherein the groups of individuals determined correspond to groups of rings deposited by at least one given tunnel boring machine on at least one boring site.

8. The method according to claim 1, further comprising, prior to determining the group of individuals corresponding to the measured at least one boring parameter, calculating at least one of the set of variables based on the measured at least one boring parameter, and wherein, while determining the group of individuals corresponding to the measured at least one boring parameter, determining the group of individuals by applying the ground/machine interaction model and to the variables thus determined.

9. The method according to claim 1, wherein, during boring, the tunnel boring machine successively deposits a plurality of rings, and further comprising for each ring of the plurality:

measuring at least one boring parameter, the at least one boring parameter comprising a torque of a cutting wheel of the tunnel boring machine, a speed of rotation of a cutting wheel of the tunnel boring machine, a speed of advance of the tunnel boring machine, and a contact force of the tunnel boring machine, determining the group of individuals corresponding to the measured at least one boring parameter using the ground/machine interaction model, and modifying at least one of the boring parameters of the tunnel boring machine as a function of the group of individuals thus determined.

10. The method according to claim 1, wherein the energy formulas comprise a rotation energy, a translation energy index, and a friction coefficient.

11. A system comprising:

a database storing a set of boring parameters characterizing formation of a bore by at least one given tunnel boring machine over at least one boring site and storing a ground/machine interaction model determined by:

identifying a set of energy formulas depending on at least one of the set of boring parameters, the at least one boring parameter including a torque of a cutting wheel of the at least one given tunnel boring machine, a speed of rotation of the cutting wheel of the at least one given tunnel boring machine, a speed of advance of the at least one given tunnel boring machine, a contact force of the at least one given tunnel boring machine, a surface area of the cutting wheel of the at least one given tunnel boring machine, a radius of the cutting wheel of the at least one given tunnel boring machine, and a confinement pressure at an axis of the at least one given tunnel boring machine, determining a set of variables based on the energy formulas thus identified, the set of variables including an average, maximum, and/or standard deviation of the energy formulas, applying a non-supervised classification algorithm to the variables so as to obtain groups of individuals identified according to a predefined criterion of the non-supervised classification algorithm, and applying a supervised classification algorithm to the variables and to the groups of individuals thus determined so as to obtain a ground/machine interaction model connecting the variables to the groups of individuals; and a processor configured to:

measure, while boring a ground with a tunnel boring machine, at least one boring parameter, the at least one boring parameter comprising a torque of a cutting wheel of the tunnel boring machine, a speed of rotation of a cutting wheel of the tunnel boring machine, a speed of advance of the tunnel boring machine, and a contact force of the tunnel boring machine, determine the group of individuals corresponding to the measured at least one boring parameter using the ground/machine interaction model, and modify at least one of the boring parameters of the tunnel boring machine as a function of the group of individuals thus determined.

* * * * *